US005312722A

United States Patent [19]

Harada

[11] Patent Number: 5,312,722

[45] Date of Patent: May 17, 1994

[54] SILVER HALIDE PHOTOGRAPHIC MATERIAL

[75] Inventor: Toru Harada, Kanagawa, Japan

[73] Assignee: Fuji Photo Film Co., Ltd., Kanagawa, Japan

[21] Appl. No.: 55,370

[22] Filed: May 3, 1993

[30] Foreign Application Priority Data

May 11, 1992 [JP] Japan ..... 4-117584

[51] Int. Cl.[5] ..... G03C 1/815; G03C 1/825

[52] U.S. Cl. ..... 430/517; 430/510; 430/522; 430/944; 430/593; 430/594; 430/595

[58] Field of Search ..... 430/510, 517, 522, 944, 430/351, 332, 340, 343, 593, 594, 595

[56] References Cited

U.S. PATENT DOCUMENTS

| | | | |
|---|---|---|---|
| 3,793,313 | 2/1974 | Rillaers et al. . | |
| 4,353,971 | 10/1982 | Chang et al. | 430/58 |
| 4,933,269 | 6/1990 | Parton et al. | 430/522 |
| 5,190,849 | 3/1993 | Santoh et al. | 430/495 |

FOREIGN PATENT DOCUMENTS

| | | |
|---|---|---|
| 0207317 | 1/1987 | European Pat. Off. . |
| 0483740 | 5/1992 | European Pat. Off. . |
| 1930224 | 1/1970 | Fed. Rep. of Germany . |
| 1551554 | 1/1968 | France . |
| 0258550 | 12/1985 | Japan . |
| 0258551 | 12/1985 | Japan . |
| 0258552 | 12/1985 | Japan . |
| 0258553 | 12/1985 | Japan . |
| 0258554 | 12/1985 | Japan . |
| 0258555 | 12/1985 | Japan . |

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

Disclosed is a silver halide photographic material containing at least one dye of formula (Ia), (Ib), (Ic), or (Id):

(Ia)

(Ib)

(Ic)

(Id)

wherein $R^1$, $R^2$, $R^9$ and $R^{10}$ may be the same or different and each represents an alkyl group; $Z^1$, $Z^2$, $Z^3$ and $Z^4$ each represents a non-metallic atomic group necessary for forming a nitrogen-containing hetero ring; $R^3$, $R^4$, $R^5$, $R^6$, $R^{11}$, $R^{12}$, $R^{13}$ and $R^{14}$ may be the same or different and each represents a hydrogen atom, an alkyl group, an aryl group or an aralkyl group; $R^7$, $R^8$, $R^{15}$ and $R^{16}$ may be the same or different and each represents a hydrogen atom, a halogen atom, an alkyl group, an alkoxy group, an amino group or a hydroxyl group; $R^3$ and $R^4$, $R^5$ and $R^6$, $R^{11}$ and $R^{12}$, $R^{13}$ and $R^{14}$, $R^3$ and $R^7$, $R^5$ and $R^8$, $R^{11}$ and $R^{15}$, or $R^{13}$ and $R^{16}$ may be bonded to each other to form a 5-membered or 6-membered ring; and m and n each represents an integer of from 1 to 4; provided that the dye molecule contains at least two acidic substituents.

16 Claims, No Drawings

SILVER HALIDE PHOTOGRAPHIC MATERIAL

FIELD OF THE INVENTION

The present invention relates to a silver halide photographic material having a colored hydrophilic colloid layer. More precisely, it relates to a silver halide photographic material having a hydrophilic colloid layer containing a dye which has absorption in the infrared range, which exists stably in the photographic material, and which is photochemically inactive and is easily decolored when the photographic material is processed.

BACKGROUND OF THE INVENTION

In the preparation of silver halide photographic materials, coloration of photographic emulsion layers or other layers is often effected for the purpose of absorbing light falling within a particular wavelength range.

If it is necessary to control the spectral composition of the light penetrating into photographic emulsion layers, a colored layer is provided on the support in a position farther from the support than photographic emulsion layers. The colored layer of the kind is called a filter layer. In the case of a multi-layered color photographic material having a plurality of photographic emulsion layers, the filter layer may be positioned intermediate between those emulsion layers.

Blur of images (i.e., halation) may be caused by repenetration of light which scatters during or after passing through photographic emulsion layers and is reflected on the interface between the emulsion layer and the support or on the surface of the photographic material opposite to the emulsion layer, into the photographic emulsion layers. This may be prevented by a colored layer provided between the photographic emulsion layer and the support or on the surface of the support opposite to the photographic emulsion layer. The colored layer is called an anti-halation layer. In the case of a multi-layered color photographic material, the anti-halation layer may be provided intermediate between the respective layers.

For the purpose of preventing lowering of the image sharpness caused by scattering of light in photographic emulsion layers (this phenomenon is generally called "irradiation"), coloration of photographic emulsion layers is also often effected.

The layers to be colored for these purposes are mostly hydrophilic colloid layers, and in general, water-soluble dyes are incorporated into the layers so as to color them. The dyes must satisfy the following conditions:

(1) they have a suitable spectral absorption in accordance with their use and the object;

(2) they are photochemically inactive. That is to say, they do not have any harmful influence on the chemical properties of silver halide photographic materials. For example, they do not lower the sensitivity of the materials, they do not cause latent image fading, and they do not cause fogging;

(3) they are decolored or dissolved out during the step of photographic processing of the photographic materials which contain them, so that they do not leave any harmful coloration on the processed photographic materials; and (4) they have an excellent time-dependent storage stability in solutions or in photographic materials.

Many dyes have heretofore been known to satisfy these conditions, and to absorb visible rays or ultra-violet rays. They are suitable for improving the images formed in conventional photographic elements which are sensitized to be sensitive to lights having a wavelength of 700 nm or less. In particular, triarylmethane and oxonole dyes have been used widely.

On the other hand, there is a need for anti-halation and anti-irradiation dyes capable of absorbing light falling within the infrared spectral range for near-infrared sensitized recording materials, for example, for photographic recording materials for recording output with near-infrared lasers.

For instance, one means of exposing photographic materials of this kind is an image forming method by a so-called scanner system. Specifically, an original is scanned and a silver halide photographic material is exposed on the basis of the resulting image signal, so as to form a negative image or positive image corresponding to the image of the original on the photographic material.

Among the recording light sources for such a scanner recording system, semiconductor lasers are used most favorably. Devices for semiconductor lasers are small-sized and low-priced and may easily be modulated. In addition, semiconductor lasers have a longer life than other He-Ne lasers or argon lasers. Moreover, since they emit infrared rays, a light safelight may be used in handling infrared-sensitive photographic materials. Therefore, semiconductor lasers are advantageous with respect to handlability and operability.

However, since no suitable dye is known which absorbs light falling within the infrared spectral range and which satisfies the preceding conditions (1), (2), (3) and (4), especially conditions (3) and (4), there are few photographic materials having a high light sensitivity in the infrared range and having excellent anti-halation and anti-irradiation properties. Therefore, at the present, the characteristics of the semiconductor lasers having the above-mentioned excellent capacity cannot be fully utilized.

Until now, various efforts have been made to find dyes satisfying the preceding conditions, and many dyes have heretofore been proposed.

For instance, examples include the tricarbocyanine dyes described in JP-A-62-123454, JP-A-63-55544, JP-A-64-33547 (the term "JP-A" as used herein means an "unexamined published Japanese patent application"); the oxonole dyes described in JP-A-1-227148; the merocyanine dyes described in JP-A-1-234844; the tetra-aryl type polymethine dyes described in JP-A-2-216140; and the indoaniline dyes described in JP-A-50-100116, JP-A-62-3250, JP-A-2-259753.

However, there are few dyes which sufficiently satisfy all the preceding conditions.

SUMMARY OF THE INVENTION

An object of the present invention is to provide dyes satisfying the preceding conditions (1), (2), (3) and (4). In particular, it is to provide a silver halide photographic material containing such a dye which is stable in the material during storage and which leaves little color in the material after development.

It has been found that this and other objects of the invention are attained by a silver halide photographic material having a dye layer containing at least one dye of the following formula (Ia), (Ib), (Ic) or (Id):

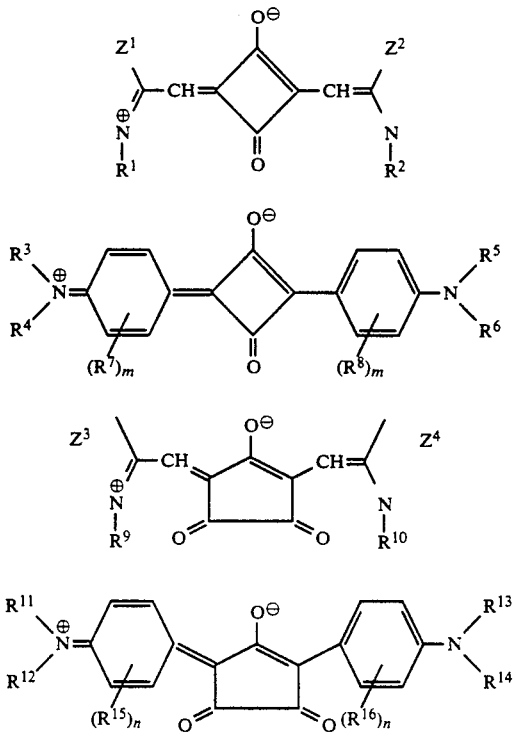

(Ia)

(Ib)

(Ic)

(Id)

wherein $R^1$, $R^2$, $R^9$ and $R^{10}$ may be the same or different and each represents an alkyl group: $Z^1$, $Z^2$, $Z^3$ and $Z^4$ each represents a non-metallic atomic group necessary for forming a nitrogen-containing heterocyclic ring; $R^3$, $R^4$, $R_5$, $R^6$, $R^{11}$, $R^{12}$, $R^{13}$ and $R^{14}$ may be the same or different and each represents a hydrogen atom, an alkyl group, an aryl group or an aralkyl group; $R^7$, $R^8$, $R^{15}$ and $R^{16}$ may be the same or different and each represents a hydrogen atom, a halogen atom, an alkyl group, an alkoxy group, an amino group or a hydroxyl group; $R^3$ and $R^4$, $R^5$ and $R^6$, $R^{11}$ and $R^{12}$, $R^{13}$ and $R^{14}$, $R^3$ and $R^7$, $R^5$ and $R^8$, $R^{11}$ and $R^{15}$, or $R^{13}$ and $R^{16}$ may be bonded to each other to form a 5-membered or 6-membered ring; and m and n each represents an integer of from 1 to 4; provided that the dye molecule contains at least two acidic substituents.

DETAILED DESCRIPTION OF THE INVENTION

Dyes represented by formulae (Ia), (Ib), (Ic) or (Id) are described in detail. The alkyl groups represented by $R^1$, $R^2$, $R^9$ and $R^{10}$ are preferably lower alkyl groups having from 1 to 5 carbon atoms (e.g., methyl, ethyl, n-butyl, isopropyl, n-pentyl). These alkyl groups may be optionally substituted by substituent(s) such as a sulfonic acid group, a carboxylic acid group and/or a hydroxyl group. More preferably, it is a lower alkyl group having from 1 to 5 carbon atoms which is substituted by a sulfonic acid group (e.g., 2-sulfoethyl, 3-sulfopropyl, 4-sulfobutyl).

The acidic substituent as referred to herein indicates a sulfonic acid group, a carboxylic acid group, a phosphonic acid group, $—SO_2NHSO_2R$ or $—CONHSO_2R$ (wherein R represents a lower alkyl group having from 1 to 5 carbon atoms, or a substituted phenyl group, which will be referred to the substituted phenyl group represented by $R^3$, $R^4$, $R^5$, $R^6$, $R^{11}$, $R^{12}$, $R^{13}$ and $R^{14}$ hereinafter). The sulfonic acid group includes a sulfo group and its salts; the carboxylic acid group includes a carboxyl group and its salts; and the phosphonic acid group includes a phosphono group and its salts. The $—SO_2NHSO_2R$ and $—CONHSO_2R$ groups may be in the form of their salts. Examples of the salts include alkali metal salts with, for example, Na or K; ammonium salts; and organic ammonium salts of, for example, triethylammonium salts, tributylammonium salts, pyridinium salts and tetrabutylammonium salts.

The nitrogen-containing heterocyclic rings formed by $Z^1$, $Z^2$, $Z^3$ and $Z^4$ include, for example, substituted and unsubstituted quinoline rings, benzothiazole rings, naphthothiazole rings, benzoxazole rings, indolenine rings and benzindolenine rings. Preferably, it is a nitrogen-containing heterocyclic ring substituted by a sulfonic acid group(s).

The alkyl groups represented by $R^3$, $R^4$, $R^5$, $R^6$, $R^{11}$, $R^{12}$, $R^{13}$ and $R^{14}$ may be the same or different, and they have the same meaning as the alkyl groups represented by $R^1$, $R^2$, $R^9$ and $R^{10}$. The aryl groups represented by $R^3$, $R^4$, $R^5$, $R^6$, $R^{11}$, $R^{12}$, $R^{13}$ and $R^{14}$ are preferably aryl groups having from 6 to 10 carbon atoms such as a phenyl group, which may optionally be substituted by substituent(s) selected from an alkyl group (having the same meaning as the alkyl groups represented by $R^1$, $R^2$, $R^9$ and $R^{10}$), a lower alkoxy group having from 1 to 5 carbon atoms (e.g., methoxy, ethoxy, sulfobutoxy), a halogen atom (e.g., F, Cl, Br), a sulfonic acid group and a carboxylic acid group. The aralkyl groups represented by $R^3$, $R^4$, $R^5$, $R^6$, $R^{11}$, $R^{12}$, $R^{13}$ and $R^{14}$ are preferably aralkyl groups having from 7 to 10 carbon atoms such as benzyl, 4-hydroxybenzyl, 4-sulfophenethyl and 3-carboxybenzyl groups. Preferred examples of $R^3$, $R^4$, $R^5$, $R^6$, $R^{11}$, $R^{12}$, $R^{13}$ and $R^{14}$ are an alkyl group substituted by a sulfonic acid or carboxylic acid group, and an unsubstituted alkyl group.

$R^7$, $R^8$, $R^{15}$ and $R^{16}$ may be the same or different and each represents a hydrogen atom, a halogen atom (e.g., F, Cl, Br), an alkyl group (having the same meaning as the alkyl groups represented by $R^1$, $R^2$, $R^9$ and $R^{10}$, preferably it is an unsubstituted lower alkyl group having from 1 to 5 carbon atoms), a lower alkoxy group having from 1 to 5 carbon atoms (e.g., methoxy, ethoxy, sulfobutoxy), an amino group, or a hydroxyl group. The amino group is $—NR^{17}R^{18}$ (wherein $R^{17}$ and $R^{18}$ each represents an alkyl group having the same meaning as the alkyl groups represented by $R^1$, $R^2$, $R^9$ and $R^{10}$, or a hydrogen atom), $—NHSO_2R^{19}$ and $—NHCOR^{19}$ (wherein $R^{19}$ represents an alkyl group having the same meaning as the alkyl groups represented by $R^1$, $R^2$, $R^9$ and $R^{10}$, or an aryl group having the same meaning as the aryl groups represented by $R^3$, $R^4$, $R^5$, $R^6$, $R^{11}$, $R^{12}$, $R^{13}$ and $R^{14}$). Preferred examples of $R^7$, $R^8$, $R^{15}$ and $R^{16}$ are a hydrogen atom, a methyl group, a hydroxyl group, a methoxy group and a sulfobutoxy group. Preferred examples of $R^{17}$, $R^{18}$, and $R^{19}$ are methyl and ethyl groups.

$R^3$ and $R^4$, $R^5$ and $R^6$, $R^{11}$ and $R^{12}$, and $R^{13}$ and $R^{14}$ may be bonded to each other to form a pyrrolidine ring, a piperidine ring or a morpholine ring. $R^3$ and $R^7$, $R^5$ and $R^8$, $R^{11}$ and $R^{15}$, or $R^{13}$ and $R^{16}$ may be bonded to each other to form a 5-membered or 6-membered ring. $R^3$ and $R^4$ may be bonded to $R^7$ to form two rings. The same is true of $R^5$ and $R^6$, $R^{11}$ and $R^{12}$, and $R^{13}$ and $R^{14}$. Examples of the rings include a 1,2,3,4-tetrahydroquinoline ring and a durolidine ring. m and n each represents an integer of from 1 to 4. The dye molecules each has at least two, preferably from 2 to 8, more preferably from 2 to 6, acidic substituents (preferably sulfonic acid groups).
Specific examples of dyes of formulae (Ia), (Ib), (Ic) and (Id) for use in the present invention are shown below, which, however, are not intended to restrict the scope of the present invention:
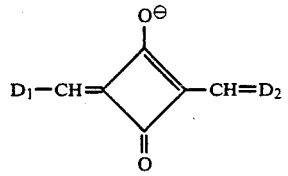
| | $D_1$ | $D_2$ |
|---|---|---|
| (Ia-1) | 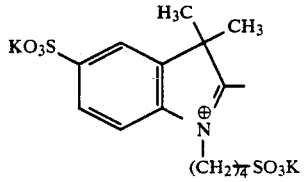 | 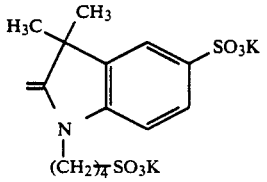 |
| (Ia-2) | 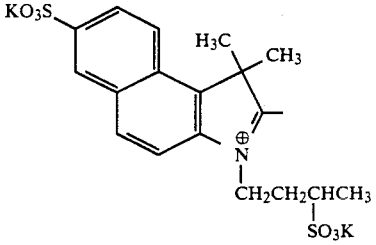 | 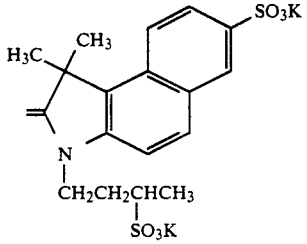 |
| (Ia-3) | 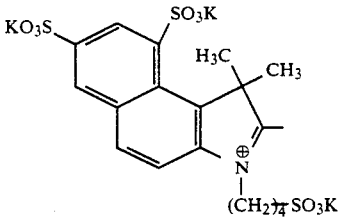 | 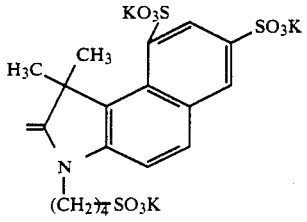 |
| (Ia-4) | 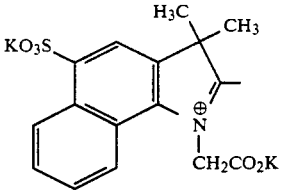 | 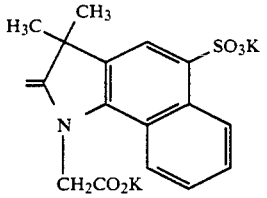 |
| (Ia-5) | 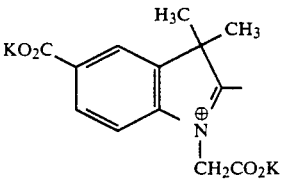 | 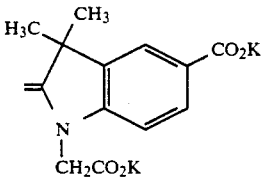 |
| (Ia-6) | 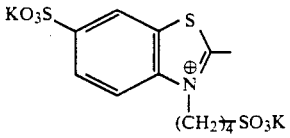 | 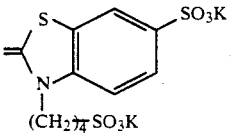 |

-continued
(Ia-7)
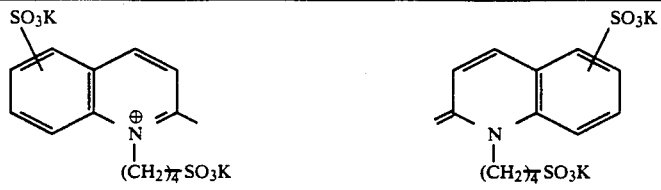
(Ia-8)
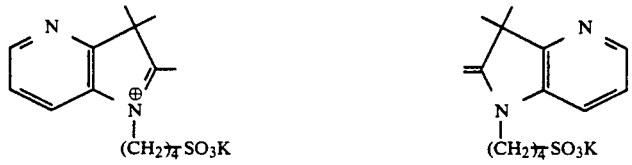
(Ia-9)
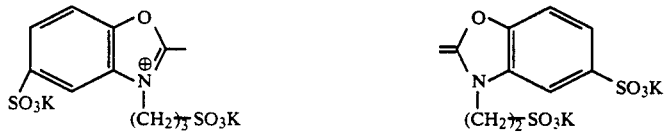
(Ia-10)
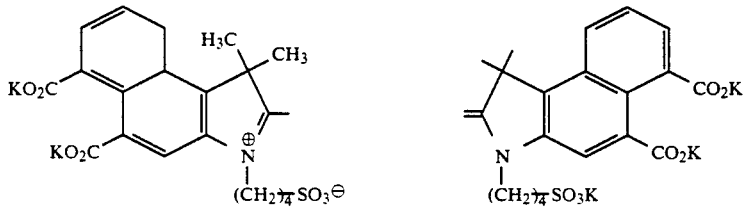
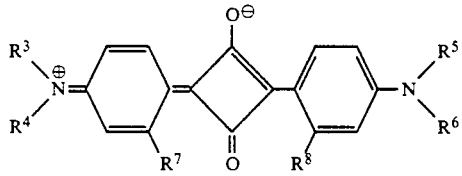
| | $R^3 = R^5$ | $R^4 = R^6$ | $R^7 = R^8$ |
|---|---|---|---|
| (Ib-1) | $-C_2H_5$ | $-(CH_2)_4SO_3K$ | $-H$ |
| (Ib-2) | $-C_2H_5$ | $-(CH_2)_3SO_3K$ | $-CH_3$ |
| (Ib-3) | $-C_2H_5$ | $-(CH_2)_4SO_3K$ | $-NHCOCH_3$ |
| (Ib-4) | $-(CH_2)_4SO_3K$ | $-(CH_2)_4SO_3K$ | $-CH_3$ |
| (Ib-5) | $-(CH_2)_4SO_3K$ | $-(CH_2)_4SO_3K$ | $-O-(CH_2)_4SO_3K$ |
| (Ib-6) | 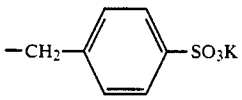 | $-C_2H_5$ | $-OH$ |
| (Ib-7) | $-CH_2CO_2K$ | $-CH_2CO_2K$ | $-CH_3$ |
(Ib-8)
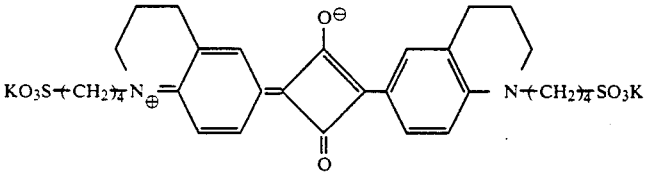
(Ib-9)
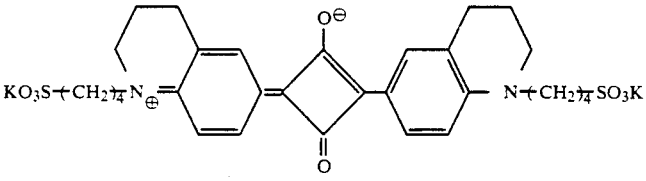

-continued
(Ib-10)
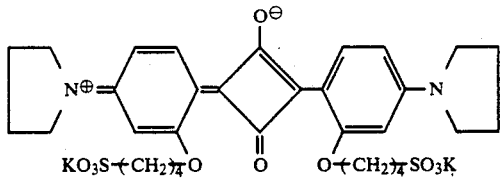
(Ib-11)
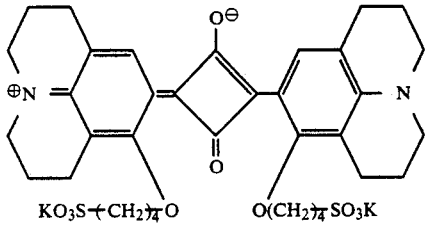
(Ib-12)
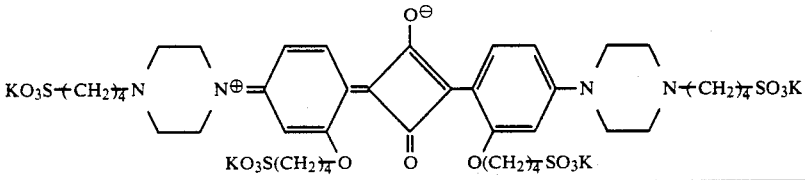
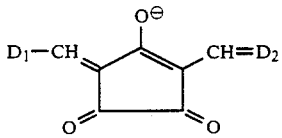
| | $D_1$ | $D_2$ |
|---|---|---|
| (Ic-1) | 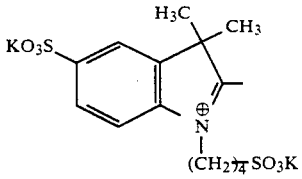 | 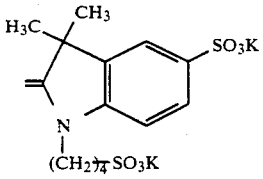 |
| (Ic-2) | 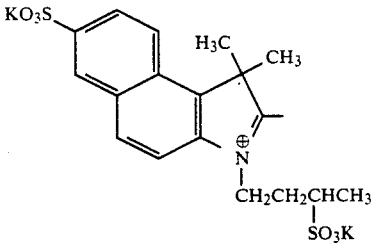 | 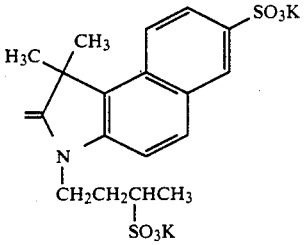 |
| (Ic-3) | 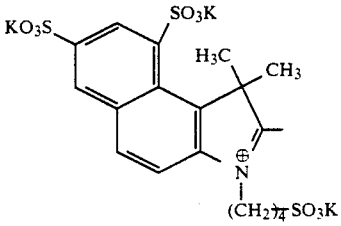 | 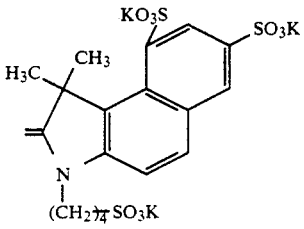 |

-continued
(Ic-4)
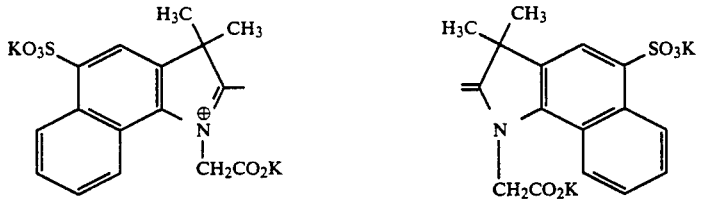
(Ic-5)
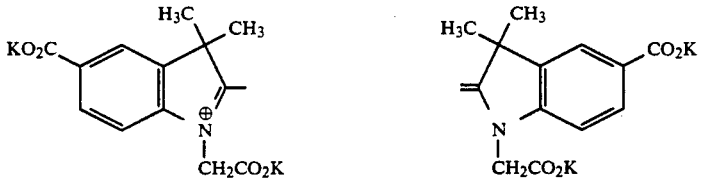
(Ic-6)
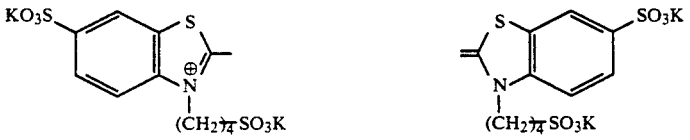
(Ic-7)
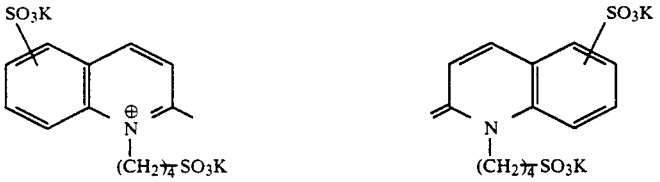
(Ic-8)
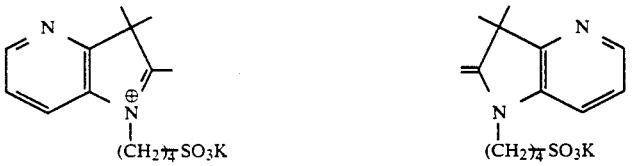
(Ic-9)
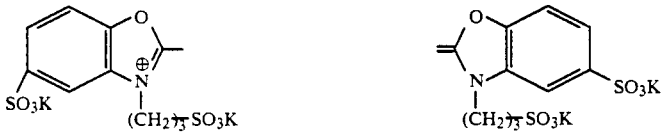
(Ic-10)
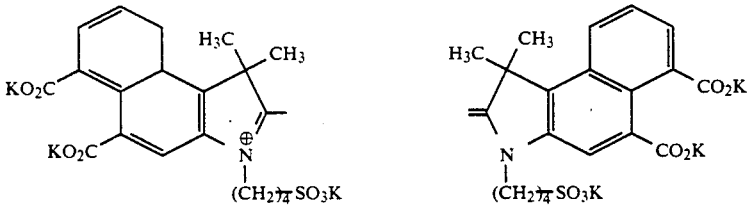
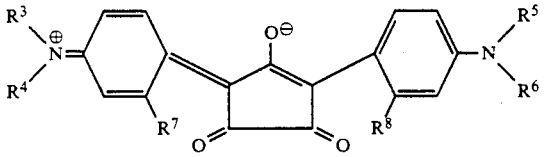
| | $R^3 = R^5$ | $R^4 = R^6$ | $R^7 = R^8$ |
|---|---|---|---|
| (Id-1) | $-C_2H_5$ | $-(CH_2)_4SO_3K$ | $-H$ |
| (Id-2) | $-C_2H_5$ | $-(CH_2)_5SO_3K$ | $-CH_3$ |
| (Id-3) | $-C_2H_5$ | $-(CH_2)_4SO_3K$ | $-NHCOCH_3$ |
| (Id-4) | $-(CH_2)_4SO_3K$ | $-(CH_2)_4SO_3K$ | $-CH_3$ |
| (Id-5) | $-(CH_2)_4SO_3K$ | $-(CH_2)_4SO_3K$ | $-O-(CH_2)_4SO_3K$ |

-continued (Id-6) $-CH_2-C_6H_4-SO_3K$ $-C_2H_5$ $-OH$ (Id-7) $-CH_2CO_2K$ $-CH_2CO_2K$ $-CH_3$ (Id-8)

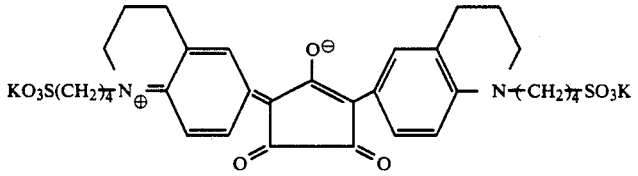

(Id-9)

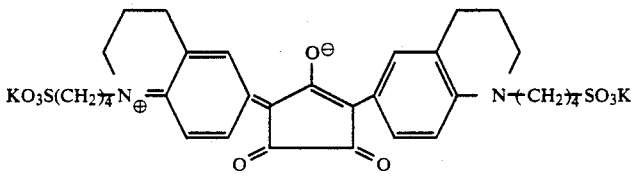

(Id-10)

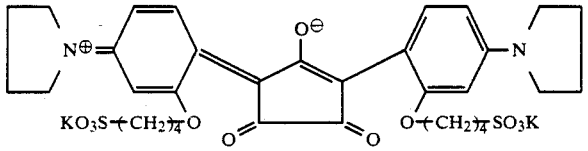

(Id-11)

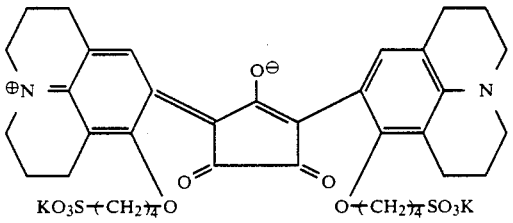

(Id-12)

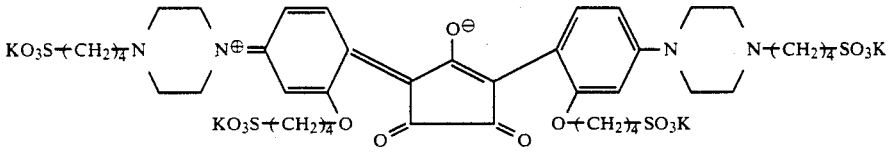

Compounds represented by formulae (Ia), (Ib), (Ic) or (Id) for use in the present invention can be produced by the methods described in JP-A-2-84383 and JP-B-51-41061 (the term "JP-B" as used herein means an "examined Japanese patent publication").

An example of the methods for producing these compounds is described below.

Production Example: Production of Compound (Ia-1)

1.2 g of 3,3-dimethyl-5-sulfo-1-sulfobutyl-indolenine and 10 ml of n-butanol were blended, and 0.45 ml of triethylamine and 0.36 g of squalinic acid were added thereto and boiled under reflux for 3 hours. After being cooled to room temperature, 1 g of potassium acetate was added thereto, and the crystals precipitated out were taken out by filtration. The crystals were recrystallized twice from a mixed solvent of water and methyl alcohol to obtain 0.4 g of the intended dye. This dye had a melting point of 200° C. or higher.

The other dyes of the present invention are also produced in the manner described above.

The dyes represented by formulae (Ia) through (Id) are dissolved in a suitable solvent (e.g., water, alcohols such as methanol or ethanol, methyl cellosolve or a mixed solvent of these), and the resulting solution is added preferably to a coating liquid for a light-sensitive or non-light-sensitive hydrophilic colloid layer; or an aqueous decomposate of the dye is added thereto. Two or more of the dyes may be combined depending on the intended purpose.

The amount of the dye to be added to the layer is generally from $1\times10^{-3}$ g/m$^2$ to 2.5 g/m$^2$, preferably from $1\times10^{-3}$ g/m$^2$ to 1.0 g/m$^2$, more preferably from $5\times10^{-3}$ g/m$^2$ to 0.5 g/m$^2$.

The photographic dyes represented by formulae (Ia) through (Id) are effective especially for anti-irradiation, and they are essentially added to emulsion layers of a photographic material when used for this purpose.

The photographic dyes represented by formulae (Ia) through (Id) are also effective especially for anti halation, and they are added to a layer on a back surface of a support of a photographic material or to an interlayer between the support and an emulsion layer of the material.

As the photographic dyes represented by formulae (Ia) through (Id) have a sharp absorption wavelength profile, they are also used advantageously in a filter layer as a filter dye which absorbs red rays to near infrared rays, and they are added to a layer on a back surface of a support of a photographic material, to an interlayer between the support and an emulsion layer of the material, to an interlayer between the emulsion layers, or to a surface protective layer of the material.

The specific constitution of the photographic material of the present invention is described below.

The silver halide emulsion for use in the present invention may comprise any composition of silver bromide, silver chlorobromide or silver iodochlorobromide and the like having a silver chloride content of 50 mol % or less. Preferably, it is silver chlorobromide having a silver chloride content of 50 mol % or less, especially preferably from 5 mol % to 40 mol %.

This is true as described in Japanese Patent Application No. 3-266934, because the silver chloride content in the emulsion should be elevated to elevate the fixability of the emulsion, but if the content is too high, the sensitivity of the emulsion is reduced.

Regarding the mean grain size of the silver halide grains for use in the present invention, the grains are desired to be fine grains, for example, having a mean grain size of 0.7 μm or less, especially preferably 0.5 μm or less.

The shape of the silver halide grains for use in the present invention may be cubic, octahedral, tetradecahedral, tabular or spherical or may be in the form of a mixture thereof. Preferred are cubic, octahedral or tabular grains.

The photographic emulsion for use in the present invention may be prepared by known methods, for example, those described in P. Glafkides, *Chimie et Physique Photographique* (published by Paul Montel, 1967), G. F. Duffin, *Photographic Emulsion Chemistry* (published by The Focal Press, 1966) and V. L. Zelikman et al, *Making and Coating Photographic Emulsion* (published by The Focal Press, 1964).

Briefly, the emulsion may be prepared by an acid method, a neutral method or an ammonia method. For forming the emulsion by reacting a soluble silver salt and soluble halide salt(s), a single jet method and a double jet method or a combination thereof may be employed.

A so-called reversed jet method of forming silver halide grains in the presence of excess silver ions may also be employed. In one embodiment of the double jet method, a so-called controlled double jet method of keeping the pAg value in the liquid phase of forming silver halide grains therein may be employed.

In accordance with the method, silver halide grains having a regular crystalline form and having nearly uniform grain sizes may be obtained.

For unifying the grain size of the silver halide grains to be formed, a method of varying the addition speed of the silver halide and the alkali halides in accordance with the growing speed of the grains to be formed, as described in British Patent 1,535,016 and JP-B-48-36890 and JP-B-52-16364, and a method of varying the concentrations of the aqueous solutions to be reacted, as described in British Patent 4,242,445 and JP-A-55-158124, are preferably employed so as to rapidly grow the silver halide grains within a range of not exceeding the critical saturation thereof.

The silver halide grains for use in the present invention may be so-called core/shell grains each having different halogen compositions in the inside (core) and the surface layer (shell).

Formation of the silver halide grains for use in the present invention is preferably effected in the presence of a silver halide solvent such as tetra-substituted thioureas or organic thioether compounds.

The preferred tetra-substituted thioureas of a silver halide solvent for use in the present invention are those described in JP-A-53-82408 and JP-A-55-77737.

The preferred organic thioethers of a silver halide solvent for use in the present invention are those containing at least one group of having an oxygen atom and a sulfur atom interrupted by ethylene therebetween (e.g., $—O—CH_2CH_2—S—$), for example, as described in U.S. Pat. No. 3,574,628 (corresponding to JP-B-47-11386); and chained thioether compounds having alkyl groups at both ends (the alkyl group each having at least two substituents selected from hydroxyl, amino, carboxyl, amido and sulfone groups), for example, as described in U.S. Pat. No. 4,276,374 (corresponding to JP-A-54-155828).

The amount of the silver halide solvent to be added varies, depending upon the kind of compounds to be reacted and the grain size and halide composition of the silver halide grains to be formed. It is preferably from $10^{-5}$ to $10^{-2}$ mol per mol of the silver halide to be formed.

If silver halide grains having a larger grain size than the one intended are formed due to addition of a silver halide solvent, the temperature in the step of forming silver halide grains and the time of adding the silver salt solution and halide solution(s) to be reacted may be varied so as to attain the intended grain size.

For forming the silver halide emulsion for use in the present invention, a water-soluble iridium compound may be added to the reaction system. For instance, examples of the compound include iridium(III) halides, iridium(IV) halides, as well as iridium complexes having halogens, amines or oxalato groups as the ligand, such as hexachloroiridium(III) or (IV) complex, hexamineiridium (III) or (IV) complex, and trioxalatoiridium(III) or (IV) complex. In the present invention, suitable iridium(III) and iridium(IV) compounds may be selected from these compounds and used in combination. The iridium compound may be used in the form of a solution dissolved in a suitable solvent. For instance, a method which is generally used for stabilizing an iridium compound solution or a method of adding an aqueous solution of a hydrogen halide (e.g., hydrochloric acid, hydrobromic acid, hydrofluoric acid) or an alkali halide (e.g., KCl, NaCl, KBr, NaBr) to the compound solution for the purpose may be employed in preparing the aqueous solution. In place of adding a water-soluble iridium compound, different iridium-doped silver halide grains may be added to the reaction system for forming silver halide grains.

The total amount of the iridium compound to be added for the preceding purpose may be $10^{-8}$ mol or more per mol of the silver halide to be formed, preferably from $1\times10^{-8}$ to $1\times10^{-5}$ mol, more preferably from $5\times10^{-8}$ to $5\times10^{-6}$ mol, per mol of the same.

Addition of the iridium compound may suitably be effected at any stage of during formation of silver halide emulsions or before coating the formed emulsions. Especially preferably, it may be added during formation of the emulsions so that the compound may be introduced into the silver halide grains formed. Rather than using the iridium compound alone, any other compound containing a VIII group atom may be combined with the iridium compound.

The silver halide photographic emulsion of the present invention may be chemically sensitized with a gold compound (gold sensitization) for the purpose of attaining high sensitivity and low fog. Gold sensitization is generally effected by adding a gold sensitizer to the emulsion followed by stirring it at a high temperature, preferably at 40° C. or higher, for a determined period of time.

The gold sensitizer for the gold sensitization is generally a gold compound having an oxidation number of gold of +1 or +3. Specific examples of the compound include potassium chloroaurates, auric trichloride, potassium auric thiocyanate, potassium iodoaurate, tetracyanoauric acid, ammonium aurothiocyanate and pyridyl trichlorogold.

The amount of the gold sensitizer to be added varies, depending upon various conditions for the sensitization. It is preferably from $1\times10^{-7}$ mol to $5\times10^{-4}$ mol per mol of the silver halide to be sensitized therewith.

The silver halide photographic emulsion for use in the present invention may be sensitized also by sulfur sensitization so as to further attain elevated sensitivity and low fog.

The sulfur sensitization is generally effected by adding a sulfur sensitizer to the emulsion to be sensitized therewith, followed by stirring it at a high temperature, preferably at 40° C. or higher, for a determined period of time.

Any known sulfur sensitizer may be used for the sulfur sensitization. For instance, they include thiosulfates, thioureas, allyl isothiocyanate, cystine, p-toluenethiosulfonates and rhodanine. Also suitable are sulfur sensitizers described in U.S. Pat. Nos. 1,574,944, 2,410,689, 2,278,947, 2,728,668, 3,501,313, 3,656,955, German Patent 1,422,869, JP-B-56 24937 and JP-A-55-45016. The amount of the sulfur sensitizer to be added for the sensitization may be a sufficient amount for effectively increasing the sensitivity of the emulsion. The amount varies, depending upon the pH and the temperature during the reaction and the size of the silver halide grains to be sensitized therewith. For instance, it is preferably from $1\times10^{-7}$ mol to $5\times10^{-4}$ mol per mol of the silver halide to be sensitized therewith.

For chemical ripening of the emulsions of the present invention, the time and order of adding the sulfur sensitizer and gold sensitizer thereto are not specifically limited. For instance, the compounds may be added simultaneously or separately to the emulsion, preferably at the start of the chemical ripening or during the chemical ripening thereof. To add them, they may dissolved in water or a water-miscible organic solvent, such as methanol, ethanol or acetone, or a mixed solvent thereof and the resulting solutions may be added to the emulsions.

Combination of sulfur sensitization with thioesulfates, selenium sensitization with selenium compounds and gold sensitization with gold compounds is advantageously employed in the present invention for effectively displaying the effect of the present invention.

The effective selenium sensitizing agent for use in the present invention is any known selenium compound such as those described in various published patent specifications. In general, unstable selenium compounds and/or non-unstable selenium compounds may be added to the emulsions to be sensitized therewith and stirred at a high temperature, preferably at 40° C. or higher, for a determined period of time. As the unstable selenium compounds for this purpose, preferred are those mentioned in JP-B-41-15748, JP-B-43-12489, JP-A-4-25832, and JP-A-4-109240. Specific examples of suitable unstable selenium sensitizers include isoselenocyanates (e.g., aliphatic isoselenocyanates such as allyl isoselenocyanate); selenoureas; selenoketones; selenoamides; selenocarboxylic acids (e.g., 2-selenopropionic acid, 2-selenobutyric acid); selenoesters; diacylselenides (e.g., bis(3-chloro-2,6-dimethoxybenzoyl)selenide); selenophosphates; phosphine selenides; and colloidal metal selenium.

Preferred examples and analogues of unstable selenium compounds for use in the present invention are mentioned below, which, however, are not limitative. For those skilled in the art, the structures of unstable selenium compounds as sensitizers for photographic emulsions are not specifically important provided that the selenium in the compounds is unstable. It is generally understood that the organic moiety in the selenium sensitizer molecule does not have any other role than to carry selenium therewith so as to release it in the emulsion as an unstable form thereof. In the present invention, every such unstable selenium compound may be employed.

Non-unstable selenium compounds for use in the present invention for sensitization of the emulsions may be those described in JP-B-46-4553, JP-B-52-34492 and JP-B-52-34491. Examples of suitable non-unstable selenium compounds include selenous acid, potassium selenocyanide, selenazoles, quaternary salts of selenazoles, diaryl selenides, diaryl diselenides, dialkyl selenides, dialkyl diselenides, 2-selenazolidinedione, 2-selenoxazolidinethione and derivatives thereof.

Sensitizing dyes preferably applied to the silver halide emulsions of the present invention are those having a spectral sensitivity in 600 nm or more, such as those having an optimum spectral sensitivity to He-Ne lasers or semiconductor lasers. Preferred sensitizing dyes include those described in JP A-3-15049, from page 12, left top column to page 21, left bottom column; JP A 3-20730, from page 4, left bottom column to page 15, left bottom column; EP-A-0420011, from page 4, line 21 to page 6, line 54; EP-A-0420012, from page 4, line 12 to page 10, line 33; EP-A-0443466; U.S. Pat. No. 4,975,362; JP-A 2-157749, pages 13 to 22; JP-A-3-171136, pages 8 to 12; and JP-A-62-215272, pages 22 to 38. Especially preferred are dyes of formulae (I), (II) and (III) described in JP-A-3-171136, pages 8 to 12. However, where the sensitizing dyes are used singly, the spectral sensitizing effect thereof is not sufficient. If the amount to be added is increased, their intrinsic desensitization would increase. So as to overcome the problem, the use of a super-color sensitizer therewith is known, for example, as described in JP-B-60-45414, JP-B-46-10473 and JP-A-59-192242.

The preceding sensitizing dyes may be used singly or may be used in a combination thereof. Combinations of these dyes are often used for the purpose of super-color sensitization. Along with the sensitizing dyes, dyes which do not have a color sensitizing effect by themselves or substances which do not substantially absorb visible rays but show a super-color sensitizing activity, may be incorporated into the emulsions.

Useful sensitizing dyes, the combination of super-color sensitizing dyes therewith and super-color sensitizing substances are described in *Research Disclosure*, Vol. 176, No. 17643, page 23, IV-J (issued on December, 1978), or in JP-B-49-25500, JP B-43-4933, JP-A-59-19032, JP-A-59-192242.

The optimum amount of the sensitizing dye having a spectral sensitivity in 600 nm or more to be added to the silver halide emulsion of the present invention may suitably be determined in accordance with the grain size and the halogen composition of the silver halide grains in the emulsion, the method and degree of chemical sensitization thereof, the relationship between the layer to which the compound (dye) is added and the silver halide emulsion therein, and the kind of the antifoggant to be added to the emulsion. The test for the determination is well known by those skilled in the art. In general, the amount of the dye is from $1\times10^{-7}$ mol to $1\times10^{-2}$ mol, especially preferably from $1\times10^{-6}$ mol to $5\times10^{-3}$ mol, per mol of the silver halide in the emulsion.

The super-color sensitizer for use in the present invention is preferably a compound described in JP-A-3-15049, pages 22 to 25 and JP-A-62-123454, pages 15 to 20.

The photographic material of the present invention may contain various compounds for the purpose of preventing fogging of the material and stabilizing the photographic properties thereof during the manufacture, storage or processing of the material. For instance, various compounds known as an antifoggant or stabilizer may be used for this purpose, including azoles such as benzothiazolium salts, nitroimidazoles, chlorobenzimidazoles, bromobenzimidazoles, mercaptothiazoles, mercaptobenzothiazoles, mercaptothiadiazoles, aminotriazoles, benzothiazoles and nitrobenzotriazoles; mercaptopyrimidines; mercaptotriazines; thioketo compounds such as oxazolinethione; azaindenes such as triazaindenes, tetrazaindenes (especially, 4-hydroxy-substituted (1,3,3a,7)tetrazaindenes) and pentazaindenes; benzenethiosulfonic acids; benzenesulfinic acids; and benzenesulfonic acid amides.

Polyhydroxybenzene compounds are especially preferred for this purpose, as improving the pressure resistance of photographic materials without lowering the sensitivity thereof. In particular, polyhydroxybenzene compounds having any of the following structures are preferred:

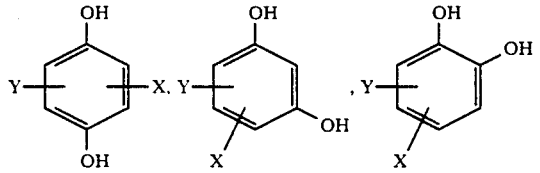

wherein X and Y each represents —H, —OH, a halogen atom, —OM (wherein M represents an alkali metal ion), an alkyl group, a phenyl group, an amino group, a carbonyl group, a sulfone group, a sulfonated phenyl group, a sulfonated alkyl group, a sulfonated amino group, a sulfonated carbonyl group, a carboxyphenyl group, a carboxyalkyl group, a carboxyamino group, a hydroxyphenyl group, a hydroxyalkyl group, an alkylether group, an alkylphenyl group, an alkyl-thioether group or a phenyl-thioether group. More preferably, they are each —H, —OH, —Cl, —Br, —COOH, $-CH_2CH_2COOH$, $-CH_3$, $-CH_2CH_3$, $-CH(CH_3)_2$, $-C(CH_3)_3$, —CHO, $-SO_3Na$, $-SO_3H$, $-SCH_3$,

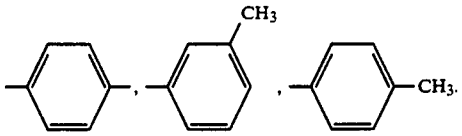

X and Y may be the same or different.

Polyhydroxybenzene compounds may be added either to the emulsion layers of photographic materials or to any other layer. The amount to be added is effectively from $1\times10^{-5}$ to mol, especially preferably from $1\times10^{-3}$ to $1\times10^{-1}$ mol, per mol of silver halide in the material.

The photographic material of the present invention may contain water-soluble dyes in the hydrophilic colloid layer as a filter dye or for anti-irradiation and for other various purposes. Such dyes include, for example, oxonole dyes, hemioxonole dyes, styryl dyes, merocyanine dyes, cyanine dyes and azo dyes. Of them, especially useful are oxonole dyes, hemioxonole dyes, cyanine dyes and merocyanine dyes.

The photographic emulsion layers constituting the photographic material of the present invention may contain, for the purpose of elevation of sensitivity, contrast and developability of the material, a developing agent such as polyalkylene oxides or their ether, ester or amine derivatives, thioether compounds, thiomorpholines, quaternary ammonium compounds, urethane derivatives, urea derivatives, imidazole derivatives, 3-pyrazolidones and aminophenols.

Of them, especially preferred are 3-pyrazolidones (e.g., 1-phenyl-3-pyrazolidone, 1-phenyl-4-methyl-4-hydroxymethyl-3-pyrazolidone). In general, the content of the developing agent in the material is 5 $g/m^2$ or less, especially preferably from 0.01 to 0.2 $g/m^2$.

The photographic emulsions or non-light-sensitive hydrophilic colloids constituting the photographic material of the present invention may contain an inorganic or organic hardening agent. For instance, the agents may be active vinyl compounds (e.g., 1,3,5-triacryloylhexahydro-s-triazine, bis(vinylsulfonyl)methylether, N,N-methylene-bis-[β-(vinylsulfonyl)propionamide]), active halides (e.g., 2,4-dichloro-6-hydroxy-s-triazine), mucohalogenic acids (e.g., mucochloric acid), N-carbamoylpyridinium salts (e.g., 1-morpholinocarbonyl-3-pyridiniomethane sulfonate), haloamidinium salts (e.g., 1-(1-chloro-1-pyridinomethylene)pyrrolidinium) and 2-naphthalenesulfonate, singly or in combinations thereof. In particular, the active vinyl compounds described in JP-A-53-41220, JP-A-53-57257, JP-A-59-162546 and JP-A-60-80846 and the active halides described in U.S. Pat. No. 3,325,287 are preferred.

The photographic emulsion layers or other hydrophilic colloid layers constituting the photographic material of the present invention may contain various surfactants for the purposes of coating aid, preventing static charging, improving the slide property, promoting emulsification and dispersion, preventing adhesion and improving photographic characteristics (e.g., promotion of developability, elevation of contrast, elevation of sensitivity).

For instance, suitable for these purposes are nonionic surfactants such as saponins (steroid type), alkylene oxide derivatives (e.g., polyethylene glycol, polyethylene glycol/polypropylene glycol condensates, polyethylene glycol alkyl ethers, polyethylene glycol alkylaryl ethers, polyethylene glycol esters, polyethylene glycol sorbitan esters, polyalkylene glycol alkylamines or amides, silicone-polyethylene oxide adducts), glycidol derivatives (e.g., alkenylsuccinic acid polyglycerides, alkylphenol polyglycerides), fatty acid esters of polyalcohols, and alkyl esters of saccharides; anionic surfactants containing acid groups (e.g., a carboxyl group, a sulfo group, a phospho group, a sulfate group or a phosphate group) such as alkylcarboxylic acid salts, alkylsulfonic acid salts, alkylbenzenesulfonic acid salts, alkylnaphthalenesulfonic acid salts, alkylsulfate esters, alkylphosphate esters, N-acyl-N-alkyltaurins, sulfosuccinate esters, sulfoalkylpolyoxyethylene alkylphenyl ethers, and polyoxyethylene alkylphosphate esters; amphoteric surfactants such as amino acid salts, aminoalkylsulfonic acids, aminoalkylsulfate or phosphate esters, alkylbetains, and amineoxides; and cationic surfactants such as alkylamine salts, aliphatic or aromatic quaternary ammonium salts, heterocyclic quaternary ammonium salts (e.g., pyridinium or imidazolium salts), and aliphatic or heterocyclic phosphonium or sulfonium salts.

The antistatic agents for this purpose are preferably fluorine-containing surfactants such as those described in JP-A-60-80849.

The photographic material of the present invention may contain a matte agent such as silica, magnesium oxide or polymethyl methacrylate in the photographic emulsion layers or other hydrophilic colloid layers constituting the material, for the purpose of preventing adhesion of the material.

The photographic material of the present invention may also contain a dispersion of a water-insoluble or hardly soluble synthetic polymer for the purpose of improving the dimensional stability of the material. For instance, suitable are homopolymers or copolymers composed of alkyl (meth)acrylates, alkoxyacryl (meth-)acrylates and glycidyl (meth)acrylates, optionally with acrylic acid and methacrylic acid.

The binder for the photographic emulsion or the protective colloid, advantageously used is gelatin. Any other hydrophilic colloid may also be used in addition to gelatin. For instance, suitable are proteins such as gelatin derivatives, graft polymers of gelatin and high polymers, albumin and casein; saccharide derivatives such as cellulose derivatives (e.g., hydroxyethyl cellulose, carboxymethyl cellulose, cellulose sulfates), sodium alginate and starch derivatives; and other various synthetic hydrophilic high polymer substances of homopolymers or copolymers such as polyvinyl alcohol, polyvinyl alcohol partial acetal, poly-N-vinylpyrrolidone, polyacrylic acid, polymethacrylic acid, polyacrylamide, polyvinyl imidazole and polyvinyl pyrazole.

As the gelatin, suitable are, for example, a lime-processed gelatin and an acid processed gelatin, as well as hydrolysates of gelatin and enzyme-decomposed products of gelatin.

The silver halide emulsion layer constituting the photographic material of the present invention may contain a polymer latex such as an alkyl acrylate latex.

The support for the photographic material of the present invention is, for example, cellulose triacetate, cellulose diacetate, nitrocellulose, polystyrene or polyethylene terephthalate paper, baryta-coated paper, or polyolefin coated paper.

For the exposure of the photographic material of the present invention, JP-A-2-285345 is referred to.

The developing agent in the developer for use in development of the photographic material of the present invention is preferably selected from dihydroxybenzenes and 3-pyrazolidones for attaining high sensitivity of the material. Especially preferred are hydroquinone, 1-phenyl-3-pyrazolidone and 1-phenyl-4-methyl-4-hydroxy-methyl-3-pyrazolidone.

The sulfites used in the present invention as a preservative in the developer include, for example, sodium sulfite, potassium sulfite, lithium sulfite, ammonium sulfite, sodium bisulfite, potassium metabisulfite, and formaldehyde-sodium bisulfite. The content of the sulfite in the developer is preferably 0.25 mol/liter or more, especially preferably 0.4 mol/liter or more. The upper limit thereof is preferably up to 2.5 mol/liter, especially preferably 1.2 mol/liter.

For adjusting the pH value of the developer, an alkali agent may be incorporated thereinto. It includes, for example, a pH adjusting agent or a buffer, such as sodium hydroxide, potassium hydroxide, sodium carbonate or potassium carbonate.

Other various additives may be in the developer, which include, for example, a development inhibitor such as boric acid, borax and the like compounds as well as sodium bromide, potassium bromide and potassium iodide; an organic solvent such as ethylene glycol, diethylene glycol, triethylene glycol, dimethylformamide, methyl cellosolve, hexylene glycol, ethanol and methanol; and an antifoggant or a black pepper inhibitor such as mercapto compounds (e.g., 1-phenyl-5-mercaptotetrazole, sodium 2-mercaptobenzimidazole-5-sulfonate), indazole compounds (e.g., 5-nitroindazole), and benzotriazole compounds (e.g., 5-methylbenzotriazole). In addition, the developer may further contain, if desired, a color toning agent, a surfactant, a defoaming agent, a water softener, a hardening agent, and the amino compounds described in JP-A-56-106244, JP-A-61-267759 and JP-A 1-29418.

The developer for use in the present invention may also contain the compounds described in JP-A-56-24347 as a silver stain inhibitor; the compounds described in JP-A-62-212651 as a development unevenness inhibitor, and the compounds described in JP-A 61-267759 as a dissolution aid.

The developer for use in the present invention may also contain, as a buffer, boric acid as described in JP-A-61-28708, and saccharides (e.g., saccharose), oximes (e.g., acetoxime) and phenols (e.g., 5-sulfosalicylic acid) as described in JP-A-60-93433.

The photographic material of the present invention may be processed in the presence of a polyalkylene oxide. In order to incorporate a polyalkylene oxide into the developer with which the material is processed, the polymer is desired to be a polyethylene glycol having a mean molecular weight of 1000 to 6000; and the content of the polymer in the developer is desired to be from 0.1 to 10 g/liter.

The fixer to be applied to the photographic material of the present invention may contain, in addition to a fixing agent, a water-soluble aluminum compound as a hardening agent. If desired, it may further contain acetic acid or a dibasic acid (e.g., tartaric acid, citric acid or their salts) to be an acidic aqueous solution having a pH of 3.8 or more, preferably from 4.0 to 6.5.

The fixing agent in the fixer may be sodium thiosulfate and ammonium thiosulfate. In view of the fixing rate, ammonium thiosulfate is especially preferred. The amount of the fixing agent in the fixer may suitably be varied and is, in general, from 0.1 to 5 mol/liter.

The water-soluble aluminum salt which acts essentially as a hardening agent in the fixer is a compound which is generally known as a hardening agent for an acidic hardening fixer, and it includes, for example, aluminum chloride, aluminum sulfate and potassium alum.

As the preceding dibasic acid, suitable are tartaric acid and its derivatives, and citric acid and its derivatives. They may be used either singly or in a combination of two or more. The content of the compound in the fixer is effectively 0.005 mol/liter or more, especially effectively from 0.01 mol/liter to 0.03 mol/liter.

Specifically mentioned are tartaric acid, potassium tartarate, sodium tartarate, sodium potassium tartarate, ammonium tartarate, and potassium ammonium tartarate.

Effective examples of citric acid and its derivatives for use in the present invention include citric acid, sodium citrate and potassium citrate.

The fixer for use in the present invention may further contain, if desired, a preservative (e.g., sulfites, bisulfites), a pH buffer (e.g., acetic acid, boric acid), a pH adjusting agent (e.g., ammonia, sulfuric acid), an image storability improving agent (e.g., potassium iodide), and a chelating agent. The content of a pH buffer in the fixer may be approximately from 10 to 40 g/liter, more preferably from 18 to 25 g/liter, since the pH value of the developer is high.

The rinsing water to be applied to the processed photographic material of the present invention may contain, if desired, a microbicide (e.g., compounds described in H. Horiguchi, *Bactericidal and Fungicidal Chemistry* (published by Sankyo Publishing Co., 1982), and JP-A-62-115154), a rinsing promoter (e.g., sulfites), and a chelating agent.

The developed and fixed photographic material of the present invention is rinsed in water and then dried. The rinsing is effected for the purpose of almost completely removing the silver salts dissolved by the previous fixation, and it is preferably conducted at 20° C. to 50° C. for 10 seconds to 3 minutes. The drying is conducted at 40° C. to 100° C. The drying time may suitably be varied in accordance with the ambient conditions, and it is generally from 5 seconds to 3 minutes and 30 seconds.

The photographic material of the present invention may be processed with a roller-conveying type automatic developing machine, which is described in, for example, U.S. Pat. Nos. 3,025,779 and 3,545,971. The machine is referred to herein as a roller conveying type processor. The roller-conveying type processor comprises four steps of development, fixation, rinsing and drying. Most preferably for processing the photographic material of the present invention, the four process steps do not exclude other steps (e.g., stopping step).

In the rinsing step, the amount of the replenisher to the rinsing tank may be from 0 ml/m$^2$ to 1200 ml/m$^2$.

When the amount of the replenisher to the rinsing or stabilization tank is 0 ml/m$^2$, the rinsing is effected by a so-called stagnant water rinsing system. As a means of reducing the amount of the replenisher to the tank, a multi-stage countercurrent system (for example, comprising two stage or three stages) has been known.

Various problems, which would result from reduction of the amount of the replenisher to the rinsing or stabilization tank, can be solved by a combination of techniques mentioned below whereby a favorable result could be obtained.

For instance, the rinsing bath or stabilization bath may contain, as a microbicide, the isothiazoline compounds described in R. T. Kreiman, *J. Image. Tech.*, Vol. 10, No. 6, page 242 (1984); the isothiazolidine compounds described in *Research Disclosure* (*R. D.*), Vol. 205, No. 20526 (May, 1981); the isothiazoline compounds described in ibid., Vol. 228, No. 22845 (April, 1983); and the compounds described in JP-A-61-115154 and JP-A-62-209532. In addition, it may also contain the various compounds described in H. Horiguchi, *Bactericidal and Fungicidal Chemistry* (published by Sankyo Publishing Co., 1982); *Handbook of Bactericidal and Fungicidal Technology* (edited by the Bactericidal and Fungicidal Society of Japan and published by Hakuhodo Publishing Co., 1986); L. E. West, "Water Quality Criteria", *Photo. Sci. & Eng.*, Vol. 9, No. 6 (1965); M. W. Beach, "Microbiological Growths in Motion Picture Processing", *SMPTE Journal*, Vol. 85 (1976); and R. O. Deegan, "Photo Processing Wash Water Biocides", *J. Imaging Tech.*, Vol. 10, No. 6 (1984).

When the processed photographic material of the present invention is rinsed with a reduced small amount of rinsing water, provision of squeeze rollers and crossover lack washing tanks as described in JP-A-63-18350 and JP-A-62-287252 is more preferred.

Water which has previously been processed to be microbicidal may be replenished to the rinsing or stabilization bath in accordance with the degree of processing of the photographic material of the invention, whereupon a part or all of the overflow from the rinsing or stabilization bath may be recirculated back to the previous step for fixation, as described in JP-A-60-235133 and JP-A-63-129343. In addition, for the purpose of preventing scummy unevenness which would often result from rinsing with a reduced amount of water and/or preventing transference of the processing components adhered to squeeze rollers to the processed film, a water-soluble surfactant or defoaming agent may be added to the rinsing water.

For the purpose of preventing the processed material from being stained with the dye liberated from the material, a dye adsorbing agent may be provided in the rinsing tank as described in JP-A 63-163456.

The photographic material of the present invention is suitable to rapid processing with an automatic developing machine with which the total processing time is from 15 seconds to 60 seconds. In processing by such rapid processing, the material displays an extremely excellent capacity.

For rapid processing of the photographic material of the present invention, the temperature and time for development and fixation are from 25° C. to 50° C. and each 25 seconds or less, preferably from 30° C. to 40° C. and each from 4 to 15 seconds.

The developed and fixed photographic material of the present invention is then rinsed in water or stabilized. The rinsing step may be effected by a counter-current rinsing system comprising 2 to 3 stages to save rinsing water. Where the material is rinsed with a reduced amount of water, a squeeze roller-equipped rinsing tank is preferably used. If desired, a part or all of the overflow from the rinsing bath or stabilization bath may be recirculated back to the previous fixation bath as described in JP-A-60 235133. Accordingly, the amount of the waste fluid from the process may be reduced preferably.

The developed, fixed and rinsed photographic material of the present invention is then dried via squeeze rollers. Drying of the material is effected at 40° to 80° C. for 4 seconds to 30 seconds.

The total processing time as referred to herein means the time from insertion of the top of the film to be processed into the inlet of the automatic developing machine to the time for taking-out the processed film from the outlet of the drying zone, via the development tank, the connecting passage, the fixation tank, the connecting passage, the rinsing tank, the connecting passage and the drying zone.

When the photographic material of the present invention is a color photographic material, it preferably contains the cyan couplers, magenta couplers and yellow couplers described in JP-A-2-285345, pages 100 to 129. Regarding the dispersion media and method for the couplers, the disclosure of JP-A-2-285345, pages 129 to 132 may be referred to. For processing such a color photographic material, the disclosure of JP-A-2-285345, from page 144, line 8 to page 168, line 11 is referred to. For scanning exposure of the photographic material of the present invention, the disclosure of JP-A-2 285345, from page 168, line 12 to page 170, line 9 is referred to. For the layer constitution of the photographic material of the invention when it is a color photographic material, the disclosure of JP-A-2-285345, from page 171, line 1 to page 172 is referred to.

The present invention will be explained in more detail by way of the following examples, which, however, are not intended to restrict the scope of the present invention.

EXAMPLE 1

1. Preparation of Silver Halide Emulsion

Forty g of gelatin was dissolved in one liter of water and heated up to 53° C. in a container. To this were added 5 g of sodium chloride, 0.4 g of potassium bromide and 60 mg of compound (A):

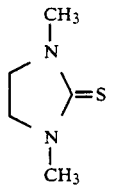

(A)

Next, 1000 ml of an aqueous solution containing 200 g of silver nitrate and 1080 ml of an aqueous solution containing potassium hexachloroiridate(III) in a molar ratio of $10^{-7}$ to the finished silver halide, along with 21 g of sodium chloride and 100 g of potassium bromide, were added thereto by a double jet method. Thus, monodispersed cubic silver chlorobromide grains having a mean grain size of 0.35 μm were prepared. The emulsion was de-salted and 40 g of gelatin was added thereto. After it was adjusted to have a pH of 6.0 and a pAg of 8.5, 2.5 mg of sodium thiosulfate and 4 mg of chloroauric acid were added thereto for chemical sensitization at 60° C. Then, 0.2 g of 4-hydroxy-6-methyl-1,3,3a,7-tetrazaindene was added thereto and rapidly cooled for solidification.

2. Preparation of Emulsion Coating Liquid

One thousand g of the emulsion prepared above was put in a container and heated up to 40° C., to which the following additives were added to prepare an emulsion coating liquid.

Formulation of Emulsion Coating Liquid:

| | | |
|---|---|---|
| a. | Emulsion | 1000 g |
| b. | Color Sensitizing Dye (2) | $1.2 \times 10^{-4}$ mol |
| c. | Super-color Sensitizer (3) | $0.8 \times 10^{-3}$ mol |
| d. | Storability Improving Agent (4) | $1 \times 10^{-3}$ mol |
| e. | Polyacrylamide (mean molecular weight: 40,000) | 7.5 g |
| f. | Trimethylol Propane | 1.6 g |
| g. | Sodium Polystyrenesulfonate | 1.2 g |
| h. | Latex of Poly(ethyl acrylate/methacrylic acid) | 12 g |
| i. | N,N'-ethylenebis-(vinylsulfonacetamide) | 3.0 g |
| j. | 1-Phenyl-5-mercaptotetrazole | 50 mg |

Compounds used above are shown below:

Color Sensitizing Dye (2):

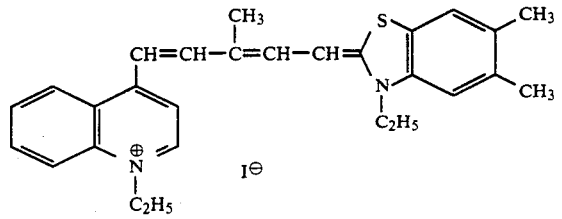

Super-color Sensitizer (3):

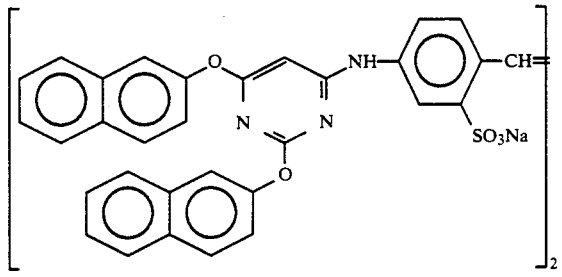

Storability Improving Agent (4):

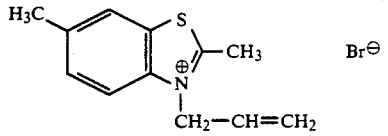

3. Preparation of Coating Liquid for Surface Protecting Layer of Protecting Emulsion Layer A container was heated up to 40° C., and the components mentioned below were put therein and formed into a coating liquid.

Formulation of Coating Liquid for Surface Protecting Layer of Protecting Emulsion Layer:

| | | |
|---|---|---|
| a. | Gelatin | 100 g |
| b. | Polyacrylamide (mean molecular weight, 40,000) | 12 g |
| c. | Sodium Polystyrenesulfonate (mean molecular weight, 600,000) | 0.6 g |
| d. | N,N'-ethylenebis-(vinylsulfonacetamide) | 2.2 g |
| e. | Fine Grains of Polymethyl Methacrylate (mean grain size 2.0 μm) | 2.7 g |
| f. | Sodium t-Octylphenoxyethoxyethanesulfonate | 1.8 g |
| g. | $C_{16}H_{33}O-(CH_2CH_2O)_{10}-H$ | 4.0 g |
| h. | Sodium Polyacrylate | 6.0 g |
| i. | $C_8F_{17}SO_3K$ | 70 mg |
| j. | $C_8F_{17}SO_2N(C_3H_7)(CH_2CH_2O)_4(CH_2)_4-SO_3Na$ | 70 mg |
| k. | NaOH (1N) | 6 ml |
| l. | Methanol | 90 ml |
| m. | Compound (5) | 0.06 g |

(5)

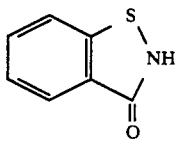

4. Preparation of Coating Liquid for Backing Layer

A container was heated up to 40° C., and components mentioned below were put therein and formed into a coating liquid for backing layer.

Formulation of Coating Liquid for Backing Layer

| | | |
|---|---|---|
| a. | Gelatin | 100 g |
| b. | Dye (1) | 4.2 g |
| c. | Sodium Polystyrenesulfonate | 1.2 g |
| d. | Poly(ethyl acrylate/methacrylic acid) Latex | 5 g |
| f. | N,N'-ethylenebis-(vinylsulfonacetamide) | 4.8 g |
| g. | Compound (5) | 0.06 g |
| h. | Dye (2) | 0.3 g |
| i. | Dye (3) | 0.05 g |

Compounds used above are as follows:

Dye (1):

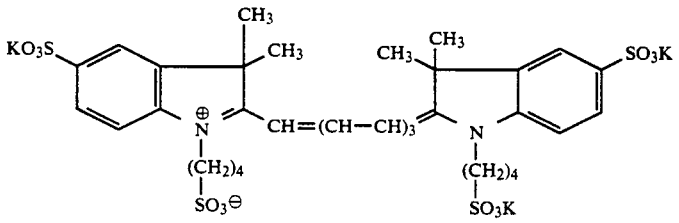

Dye (2):

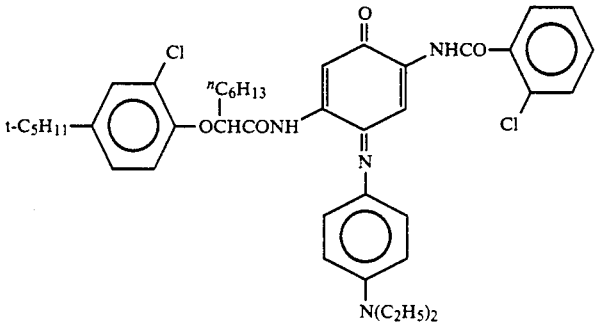

Dye (3):

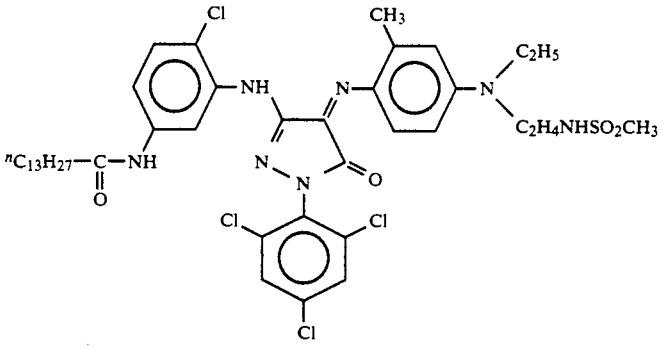

5. Preparation of Coating Liquid for Backing Surface Protecting Layer

A container was heated up to 40° C., and the components mentioned below were put therein and formed into a coating liquid.

Formulation of Coating Liquid for Back Surface Protecting Layer

| | | |
|---|---|---|
| a. | Gelatin | 100 g |
| b. | Sodium Polystyrenesulfonate | 0.5 g |
| c. | N,N'-ethylenebis-(vinylsulfonacetamide) | 1.9 g |
| d. | Fine Grains of Polymethyl Methacrylate (mean grain size 4.0 μm) | 4 g |
| e. | Sodium t-Octylphenoxyethoxyethanesulfonate | 2.0 g |
| f. | NaOH (1 N) | 6 ml |
| g. | Sodium Polyacrylate | 2.4 g |
| h. | $C_{16}H_{33}O—(CH_2CH_2O)_{10}—H$ | 4.0 g |
| i. | $C_8F_{17}SO_3K$ | 70 mg |
| j. | $C_8F_{17}SO_2N(C_3H_7)(CH_2CH_2O)_4(CH_2)_4—SO_3Na$ | 70 mg |
| k. | Methanol | 150 ml |
| l. | Compound (5) | 0.06 g |

6. Formation of Photographic Materials

The preceding coating liquid for a backing layer was coated on a polyethylene terephthalate support along with the preceding coating liquid for a protecting layer for protecting the backing layer, the total gelatin amount coated being 3 g/m$^2$. Subsequently, the preceding emulsion coating liquid and the preceding coating liquid for a protecting layer for protecting the surface of the emulsion layer were coated on the opposite surface of the support, the silver amount coated being 2.5 g/m$^2$ and the gelatin amount coated in the surface protecting layer being 1 g/m$^2$. Thus, photographic material Sample No. 1 was formed.

Photographic material Sample Nos. 2 to 7 were formed in the same manner as above, except that the same amount of Comparative Dye (4) shown below or Dye (Ia-1), (Ia-3), (Ia-7), (Ic-1) or (Ic-3) of the present invention was used in place of Dye (1).

Comparative Dye (4): (described in U.S. Pat. No. 4,839,265)

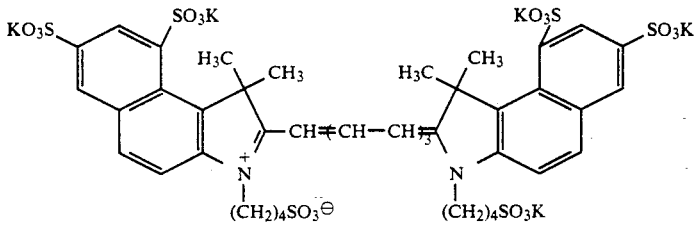

7. Evaluation of Storage Stability

Photographic material Sample No. 1 to 7 formed in the manner mentioned above and shown in Table 1 below were stored under a humidity of 70% and a temperature of 50° C. for 3 days. The reflection spectrum of each sample thus stored was measured. From the data, the variation of the light absorption at the absorption peak wavelength of each dye was obtained for each sample and is shown in Table 1. The variation is represented by the following equation.

Variation of Light Absorption

=(absorption of sample as stored under 50° C. and 70% RH)/(absorption of fresh sample before being stored under 50° C. and 70% RH)

8. Evaluation of Decolorability

Each photographic material sample shown in Table 1 was processed for forming an image thereon. The reflection spectrum of the white background area of the processed sample was measured. The light absorption of the dye at the absorption peak thereof in each sample before and after the image forming processing was measured. The color retention percentage in each sample was calculated out from the data and is shown in Table 1.

For the image forming processing, each of photographic material Sample Nos. 1 to 7 was stored under a temperature of 25° C. and a humidity of 60% for 7 days and then exposed to a semiconductor laser of 780 nm for $10^{-7}$ second at room temperature for scanning exposure. The exposed samples were then processed with the following developer (1) and fixer (1). The development time was 7 seconds, the fixation time was 7 seconds, the rinsing time was 4 seconds, and the water removing and drying time was 11 seconds.

| | |
|---|---|
| Composition of Developer (1): | |
| Potassium Hydroxide | 29 g |
| Sodium Sulfite | 31 g |
| Potassium Sulfite | 44 g |
| Ethylenetriaminetetraacetic Acid | 1.7 g |
| Boric Acid | 1 g |
| Hydroquinone | 30 g |
| Diethylene Glycol | 29 g |
| 1-Phenyl-3-pyrazolidone | 1.5 g |
| Glutaraldehyde | 4.9 g |
| 5-Methylbenzotriazole | 60 mg |
| 5-Nitroindazole | 0.25 g |
| Potassium Bromide | 7.9 g |
| Acetic Acid | 18 g |
| Water to make | 1000 ml |
| pH | 10.3 |
| Composition of Fixer (1): | |
| Ammonium Thiosulfate | 140 g |
| Sodium Sulfite | 15 g |
| Disodium Ethylenediaminetetraacetate Dihydrate | 20 mg |
| Sodium Hydroxide | 7 g |
| Aluminium Sulfate | 10 g |
| Boric Acid | 10 g |
| Sulfuric Acid | 3.9 g |
| Acetic Acid | 15 g |
| Water to make | 1000 ml |
| pH | 4.30 |

the results are shown in Table 1 below.

TABLE 1

| Photographic Material Sample No. | Dye Contained | Percentage (%) of Dye Maintained in Stored Sample | Percentage (%) of Color in Processed Sample | Remarks |
|---|---|---|---|---|
| 1 | (1) | 92 | 6 | comparative sample |
| 2 | (4) | 94 | 7 | comparative sample |
| 3 | (Ia-1) | 97 | 2 | sample of the invention |
| 4 | (Ia-3) | 98 | 3 | sample of the invention |

TABLE 1-continued

| Photographic Material Sample No. | Dye Contained | Percentage (%) of Dye Maintained in Stored Sample | Percentage (%) of Color in Processed Sample | Remarks |
|---|---|---|---|---|
| 5 | (Ia-7) | 98 | 2 | sample of the invention |
| 6 | (Ic-1) | 98 | 2 | sample of the invention |
| 7 | (Ic-3) | 97 | 3 | sample of the invention |

From the results in Table 1 above, it is obvious that the dyes of the present invention were stably maintained in the stored samples and that they were well decolored in the processed samples.

Specifically, the photographic material of the present invention is stable during storage especially with respect to the dye contained therein. That is, the dye contained in the material is not decomposed during storage of the material. After the photographic material has been processed, the dye may well be decomposed so that there is little color retention in the processed material. Thus, the dye in the photographic material of the present invention may be stable in the material during storage, while it may be well decolored in the processed sample.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon a silver halide emulsion layer and further comprising at least one dye of the formula (Ia), (Ib), (Ic) or (Id):

(Ia)

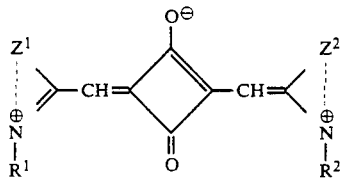

(Ib)

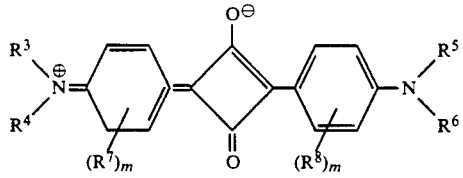

(Ic)

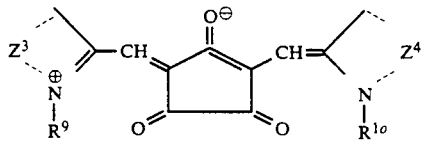

(Id)

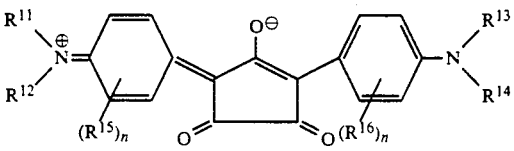

$R^1$, $R^2$, $R^9$ and $R^{10}$ are the same or different and each represents an alkyl group;

$Z^1$ $Z^2$, $Z^3$ and $Z^4$ each represents a non-metallic atomic group necessary for forming a nitrogen-containing heterocyclic ring;

$R^3$, $R^4$, $R^5$, $R^6$ $R^{11}$, $R^{12}$, $R^{13}$ and $R^{14}$ are the same or different and each represents a hydrogen atom, an alkyl group, an aryl group or an aralkyl group;

$R^7$, $R^8$, $R^{15}$ and $R^{16}$ are the same or different and each represents a hydrogen atom, a halogen atom, or alkyl group, an alkoxy group, an amino group or a hydroxyl group;

$R^3$ and $R^4$, $R^5$ and $R^6$, $R^{11}$ and $R^{12}$, $R^{13}$ and $R^{14}$, $R^3$ and $R^7$, $R^5$ and $R^8$, $R^{11}$ and $R^{15}$, or $R^{13}$ and $R^{16}$ may be bonded to each other to form a 5-membered or 6-membered ring; and m and n each represents an integer of from 1 to 4; wherein the dye contains at lest two acidic substituents.

2. The silver halide photographic material as in claim 1, wherein the dye is represented by formula (Ia).

3. The silver halide photographic material as in claim 1, wherein the dye is represented by formula (Ib).

4. The silver halide photographic material as in claim 1, wherein the dye is represented by formula (Ic).

5. The silver halide photographic material as in claim 1, wherein the dye is represented by formula (Id).

6. The silver halide photographic material as in claim 1, wherein $R^1$, $R^2$, $R^9$ or $R^{10}$ is a substituted or unsubstituted alkyl group.

7. The silver halide photographic material as in claim 1, wherein $R^1$, $R^2$, $R^9$ or $R^{10}$ is an alkyl group substituted by a sulfonic acid group.

8. The silver halide photographic material as in claim 1, wherein $Z^1$, $Z^2$, $Z^3$, or $Z^4$ is a non-metallic atomic group necessary for forming a nitrogen-containing heterocyclic ring substituted by a sulfonic acid group.

9. The silver halide photographic material as in claim 1, wherein $R^3$, $R^4$, $R^5$, $R^6$, $R^{11}$, $R^{12}$, $R^{13}$ or $R^{14}$ is an alkyl group substituted by a sulfonic acid or carboxylic acid group.

10. The silver halide photographic material as in claim 1, wherein $R^3$, $R^4$, $R^5$, $R^6$, $R^{11}$, $R^{12}$, $R^{13}$ or $R^{14}$ is an unsubstituted alkyl group.

11. The silver halide photographic material as in claim 1, wherein $R^7$, $R^8$, $R^{15}$ or $R^{16}$ is a hydrogen atom, a methyl group, a hydroxyl group, a methoxy group or a sulfobutoxy group.

12. The silver halide photographic material as in claim 1, wherein the acidic substituents are selected from the group consisting of a sulfonic acid group, a carboxylic acid group, a phosphonic acid group, $-SO_2NHSO_2R$ or $-CONHSO_2R$; wherein R represents an alkyl or substituted phenyl group.

13. The silver halide photographic material as in claim 1, wherein the acidic substituents are sulfonic acid groups.

14. The silver halide photographic material as in claim 1, wherein the dye represented by formula (Ia), (Ib), (Ic) or (Id) is used as a dye for anti-irradiation and is added to an emulsion layer.

15. The silver halide photographic material as in claim 1, wherein the dye represented by formula (Ia), (Ib), (Ic) or (Id) is used as a dye for anti-halation and is in a layer on the support surface which is opposite to the emulsion layer or in an interlayer between the support and the emulsion layer.

16. The silver halide photographic material as in claim 1, wherein the dye represented by formula (Ia), (Ib), (Ic) or (Id) is used as a filter dye and is in a layer on the support surface which is opposite to the emulsion layer, in an interlayer between the support and the emulsion layer, in an interlayer between emulsion layers, or in a surface protective layer.

* * * * *